United States Patent [19]

Brunett et al.

[11] Patent Number: 4,814,216

[45] Date of Patent: Mar. 21, 1989

[54] TRANSPARENCY MEDIUM FOR AUTOMATIC PRINTERS

[75] Inventors: Peter F. Brunett, Eggertsville; Daniel P. Fallin, Tonawanda, both of N.Y.

[73] Assignee: Graphic Controls Corporation, Buffalo, N.Y.

[21] Appl. No.: 920,302

[22] Filed: Oct. 17, 1986

[51] Int. Cl.[4] ..... B65D 65/28

[52] U.S. Cl. ..... 428/43; 40/158.1; 281/2; 281/5; 282/2; 282/5; 282/12 A; 282/21 R; 283/61; 283/62; 353/120; 353/DIG. 5; 428/14; 428/46; 428/194; 428/202; 428/203

[58] Field of Search ..... 428/77, 194, 13, 14, 428/33, 45, 46, 202, 203, 40, 43; 156/277; 40/301, 158 B, 158.1; 283/103, 61, 62; 434/365, 370; 281/2, 5; 353/120, DIG. 5; 282/2, 5, 12 A, 21 R

[56] References Cited

U.S. PATENT DOCUMENTS

| | | | |
|---|---|---|---|
| 1,261,133 | 4/1918 | Kidd | 428/43 |
| 4,231,833 | 11/1980 | Lieberman | 428/14 |
| 4,306,367 | 12/1981 | Ott | 428/43 |
| 4,705,298 | 11/1987 | Van Malderghem et al. | 282/5 |

*Primary Examiner*—Ellis P. Robinson
*Assistant Examiner*—P. R. Schwartz
*Attorney, Agent, or Firm*—Ratner & Prestia

[57] ABSTRACT

Transparency medium for automatic printers comprises transparent film sheet with central window area and surrounding margin area and a backer sheet bonded to the film sheet only in the margin area. Preferably, a sequence of such backer sheets, including side edges suitable for automatic feeding (such as by tractor pin holes) on a separate edge portion, are separably connected at adjoining forward and rearward edge lines to form a fan folded supply of indefinite length.

8 Claims, 2 Drawing Sheets

TRANSPARENCY MEDIUM FOR AUTOMATIC PRINTERS

INTRODUCTION

This invention pertains to a medium (i.e. a material on which something is printed) for use in an automatic printer or plotter and which is particularly adapted for producing transparencies (i.e. a printed image on a transparent background suitable for lighted projection of the printed image onto a viewing area such as a screen). In particular, this invention pertains to such a medium which is part of an indefinite length supply (such as a fan-folded sequence of individual print sheets) suitable for cointinuous feeding to an automatic printer or plotter.

BACKGROUND OF THE INVENTION

Automated printers (some of which produce line rather than alphanumeric images and are generally referred to as plotters) are usually controlled by computers and are capable of producing a wide variety of text, drawings, graphs, and other figures. Typically such printers print on a medium, such as paper, which is continuously fed either from roll form or from a fan-folded supply, such as that shown in U.S. Pat. No. 4,508,365—Hawes. Printing on something other than plain paper, to produce printed envelopes for example, may be accomplished by a combination of a fan-folded paper backer supply and the thing on which the print is to be made, e.g. envelopes as disclosed in U.S. Pat. No. 4,497,509—Gore.

While such printers are also useful to produce transparencies, that is transparent film sheets with images thereon suitable for projection, such transparent film sheets have not heretofore been available in convenient form particularly adapted for feeding (preferably in a continuous feed form) to an automatic printer or plotter.

One known attempt to provide a transparent film suitable for the making of transparencies on automatic printers embodied a fan-fold paper carrier web with individual transparent sheets removably adhered to individual sheets of the carrier web. This was found to be impractical because it was difficult to maintain the transparent sheet in registry with the paper backer during printing, using the separable adhesive, and also because the adhesive tended to leave a residue in the central window area of the film. This impaired the transparency of the film (after removal from the paper backer) and therefore its use as a transparent projection image. Transparencies thus produced also tended to be marked with fingerprints through handling of the film in the absence of a separate protector.

Another known transparency product is a continuous roll of film with tractor pin holes for feeding through a plotter. In addition to the difficulty in separating this continuous film media into individual sheets, other problems with this product include fingerprints on the transparency from handling and permanent curature of the film (resulting from its plastic memory of the roll form).

SUMMARY OF THE INVENTION

Briefly, this invention comprises an improved transparent medium for automatic printers wherein a transparent film sheet is secured to a flexible backer, preferably a fan folded paper carrier web. The film sheet includes a central window area and a surrounding margin area. In this margin area, the transparent film sheet is bonded to the backer or carrier sheet. The part of the backer overlying the central window area of the film sheet is adapted to be separated from the remainder of the backer sheet, such as by perforations in the backer along the line separating the window area from the margin area. The remaining backer portion provides a protective border to facilitate handling of the medium.

In accordance with the method of this invention, an improved method of making a transparency is provided wherein the printer medium comprises a transparent film sheet overlaid on a backer sheet and bonded to the carrier sheet in their common margin area. Preferably the backer sheet is adapted for feeding to an automated printer. After printing, the central portion of the backer sheet (i.e. the area surrounded by the marginal bonded area) is removed. This results in a transparency with a paper border to facilitate handling.

DETAILED DESCRIPTION OF THE INVENTION

Figure 1:
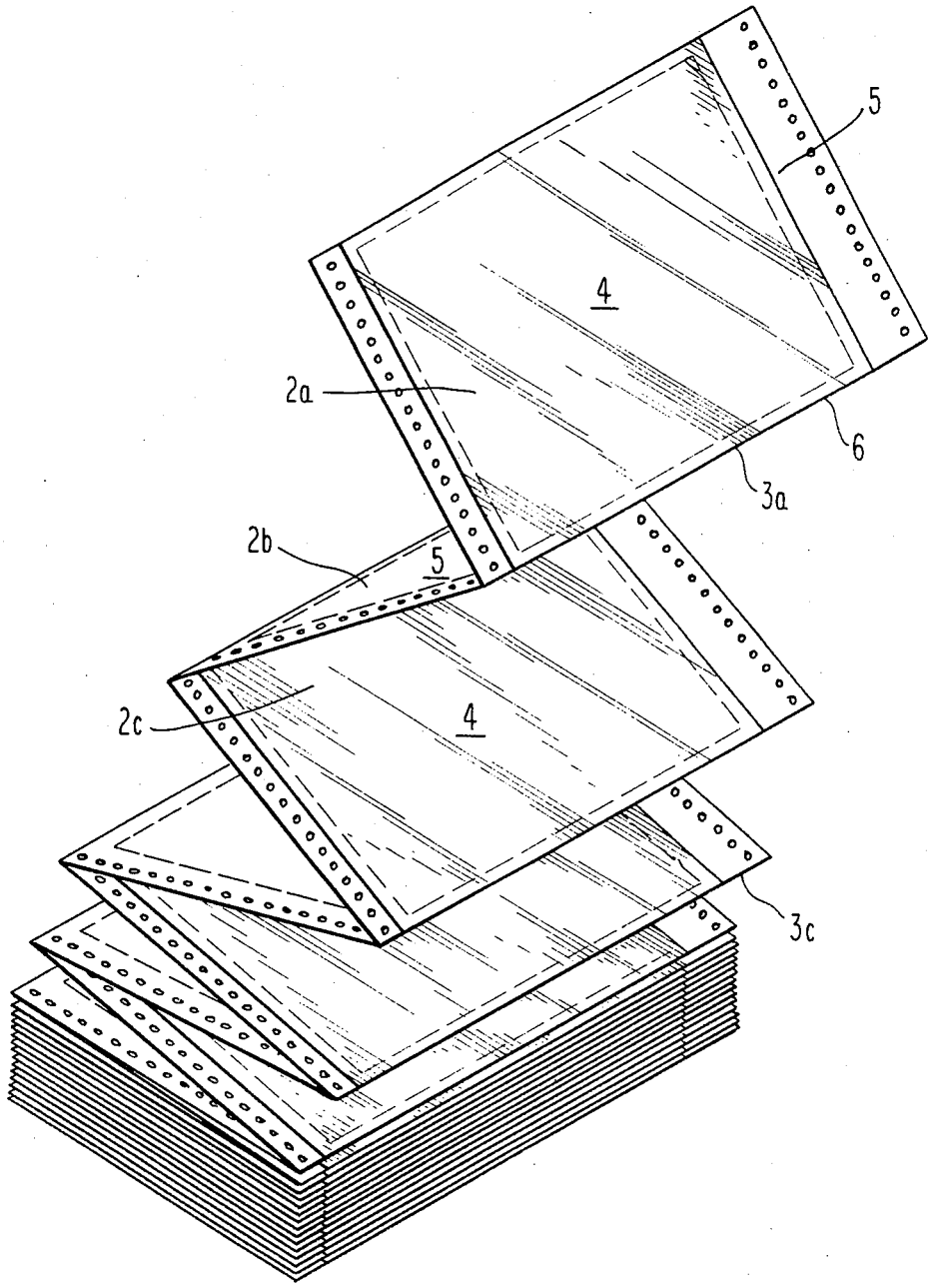
FIG. 1 is a perspective view of a fanfolded medium suitable for making transparencies in accordance with this invention.

As shown in FIG. 1, the preferred embodiment of the invention comprises a continuous fanfolded medium 1 suitable for supply to an automated printer in order to make transparencies. The medium is of indefinite length and comprises a plurality of individual segments 2*a*, 2*b*, 2*c*, etc., folded and removably connected at their adjoining edges 3*a*, 3*b*, 3*c*, etc. Each such segment 2*a*, 2*b*, 2*c* (etc.) comprises a transparent film sheet 4 bonded to a backer sheet 5.

Successive backer sheets in the indefinite length supply form are joined by perforated edge lines 6 at edges 3*a*, 3*b*, 3*c*, etc. to form a continuous fanfolded (or roll supplied if the sheets are not folded against one another) backer web. (The term "perforated" as used herein refers to any type of scoured, cut or punched hole line, including but not limited to, a series of holes or slits cut through the paper with uncut paper interspersed therewith, or a line partially cut through the paper such as a razor cut edge commonly used in automated printer medium.) The backer web may be separated at perforated edge lines 6 into individual segments as shown in FIGS. 2*a* and 2*b*.

Figure 2A:
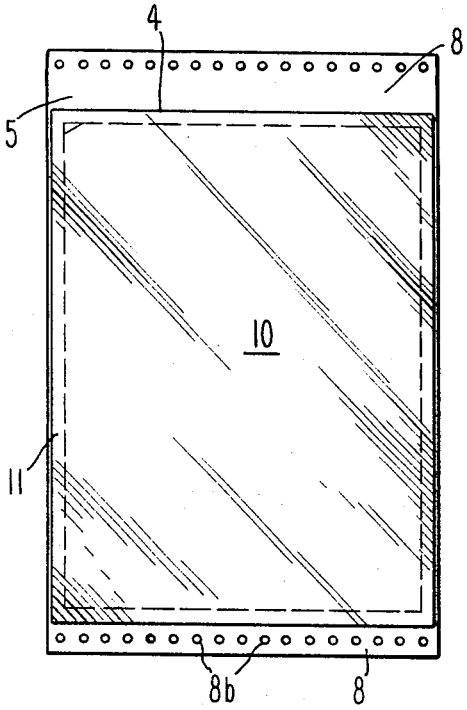
FIGS. 2*a* and 2*b* are obverse plan views of the individual sheets from the fan-folded medium of FIG. 1.
Figure 2B:
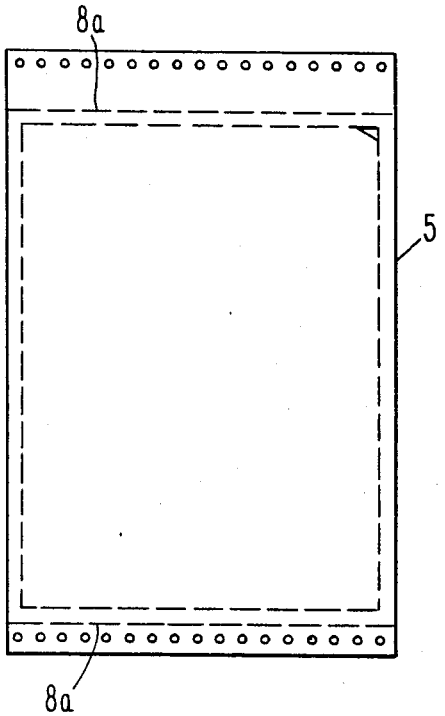

As better seen in FIGS. 2*a* and 2*b*, each segment comprises a transparent film sheet 4 having a central window area 10, surrounded by a marginal area 11. Sheet 4 is bonded to backer sheet 5 in marginal area 11.

Perforated lines 8*a* in backer sheet 5 define two removable edge portions 8 further including tractor feed pin holes 8*b* for automatic feeding of the carrier web.

On backer sheet 5, the areas overlying transparent sheet central window 10 and marginal area 11 are separated by perforated line 10*a* (preferably razor cut partially through the paper). Perforated line 10*a* may surround the cental window completely (as shown) or on only three sides thereof.

Figure 3:
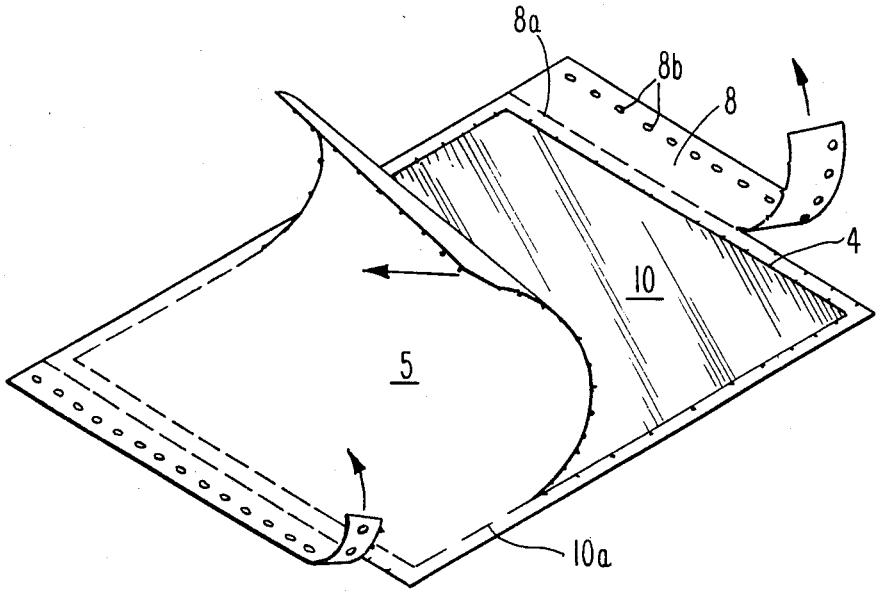
FIG. 3 is a perspective view of the individual sheet shown in FIGS. 2*a* and 2*b* illustrating the removal of a portion of that sheet.

A transparency may be made by printing on film sheet 4 and then (as shown in FIG. 3) separating that part of backer sheet 5 within perforated line 10*a* (or folding that part back if perforated line 10*a* extends on 3 sides only of central window area 10). This results in a transparency with a border area 11 attached thereto.

While this invention has been described with reference to specific embodiments thereof, it is not limited thereto. Instead, the claims which follow are intended to be construed to encompass not only the forms and embodiments of the invention shown and described, but also such other forms and embodiments and such variants and modifications thereof as may be devised by those skilled in the art without departing from the true spirit and scope of the present invention as may be ascertained from the foregoing description and accompanying drawings.

We claim:

1. A printer medium comprising:

a transparent film sheet having a central window area and a surrounding margin area;

a backer sheet completely overlying said film sheet;

said film sheet bonded to said backer only in said margin area; and means for separating a portion of said backer overlying said window area while heaving the residue of said backer in the form of a paper border bonded to said film sheet in said margin area.

2. A continuous printing web comprising a plurality of printing media as recited by claim 1, wherein said printer media are joined together in serial relationship by trailing and leading edge regions of said backer sheets to form said continuous printing web.

3. A continuous printing web, as recited in claim 2, wherein said backer sheets include separable edge portions, said edge portions having holes adapted for use on a tractor feed printer.

4. A continuous printing web as recited in claim 3, wherein said means for removal of said backer sheet portion overlying said window areas comprise a perforated lines around at least three sides of said backer sheet portion overlying said window areas, and wherein said serially joined backer sheets comprise fan folded paper.

5. A continuous printing web as recited in claim 2, wherein said serially joined backer sheets comprise fan folded paper.

6. A continuous printing web as recited by claim 2, including means for separating said serially joined backer sheets from one another.

7. A medium, as recited in claim 1, wherein said film sheet and said backer sheet are bonded throughout said marginal area.

8. A medium, as recited in claim 1, wherein said means for removal of said backer sheet portion overlying said window area comprises a perforated line around at least three sides of said backer sheet portion overlying said window area.

* * * * *